United States Patent [19]

Brenner

[11] 4,211,306

[45] Jul. 8, 1980

[54] EMERGENCY BUILDING ESCAPE LADDER

[75] Inventor: Robert Brenner, P.O. Box 4837, Incline Village, Nev. 89450

[73] Assignees: Robert Brenner; Margaret A. Brenner, both of Crystal Bay, Nev.

[21] Appl. No.: 713,138

[22] Filed: Aug. 10, 1976

[51] Int. Cl.[2] ..... E06C 9/14

[52] U.S. Cl. ..... 182/76; 182/77; 182/106; 182/163

[58] Field of Search ..... 182/70, 71, 73, 74, 182/76, 77, 78, 79, 80, 18, 163, 164

[56] References Cited

U.S. PATENT DOCUMENTS

| | | | |
|---|---|---|---|
| 280,433 | 7/1883 | Wyatt et al. | 182/106 |
| 589,569 | 9/1897 | Muller | 182/78 |

*Primary Examiner*—Reinaldo P. Machado
*Attorney, Agent, or Firm*—Herbert C. Schulze

[57] ABSTRACT

This invention is an interlocking, segmented, ladder for use on high rise buildings and the like; wherein, the ladder is stored horizontally between floors of such building so as to not create an unpleasant or dangerous permanent exterior structure, and wherein the ladder may be automatically or manually actuated in the event of an emergency, in which case each section is extended from its horizontal position of storage within the building and is rearranged in a vertical position on the exterior of the building; and, appropriate safety footings are provided for inter-locking of the various elements; and, a series of safety devices are incorporated so that persons using the ladder will not fall from it and provisions are made for safe entrance onto the ladder.

7 Claims, 15 Drawing Figures

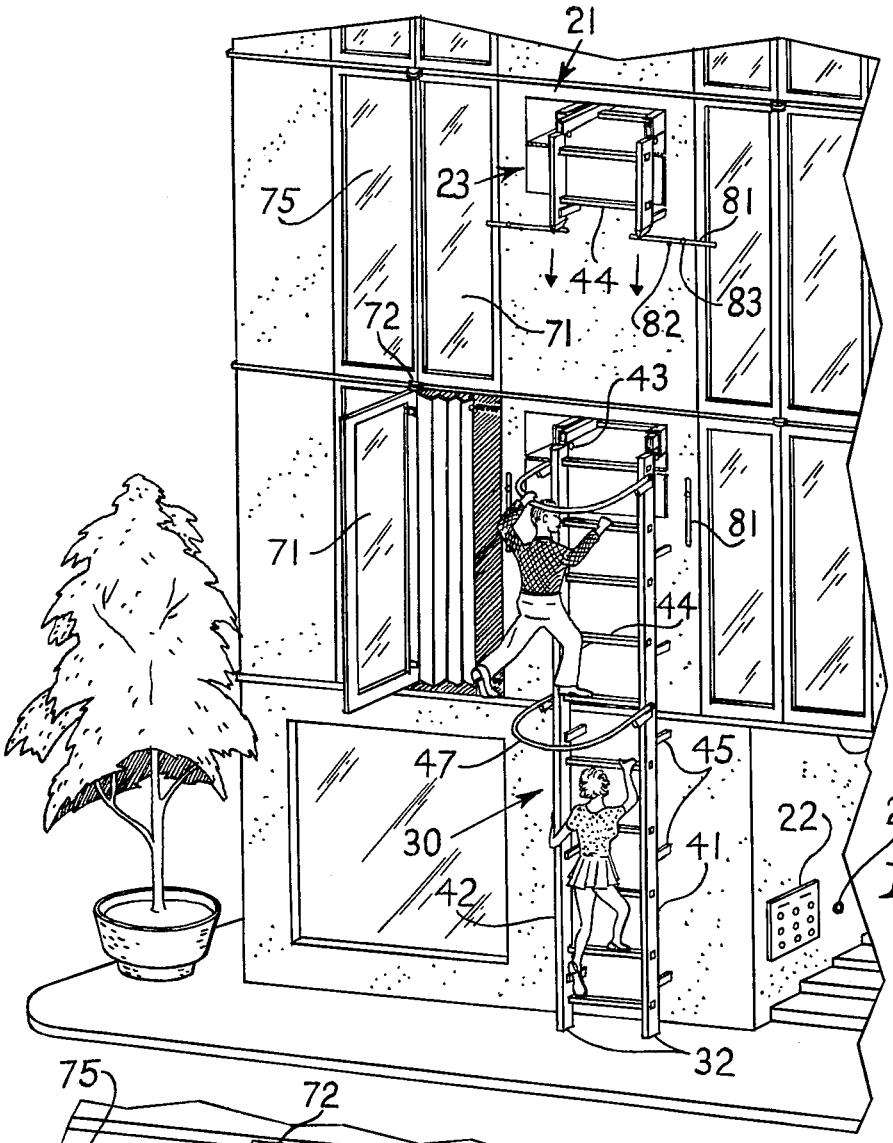
FIG.13
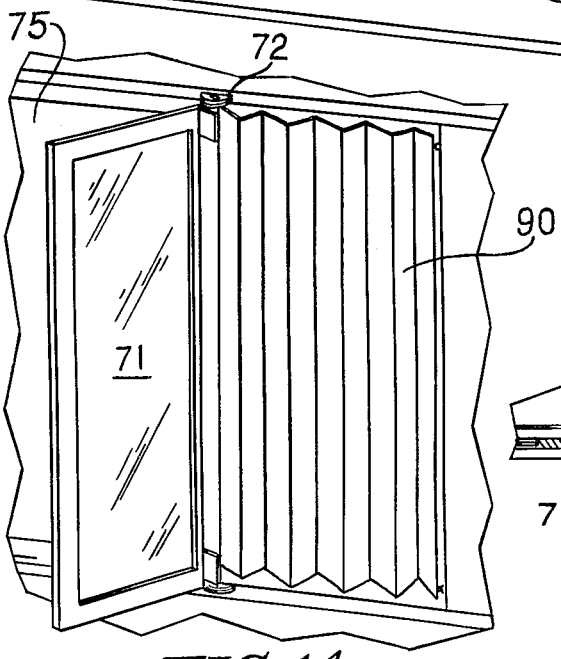
FIG. 14
FIG.15
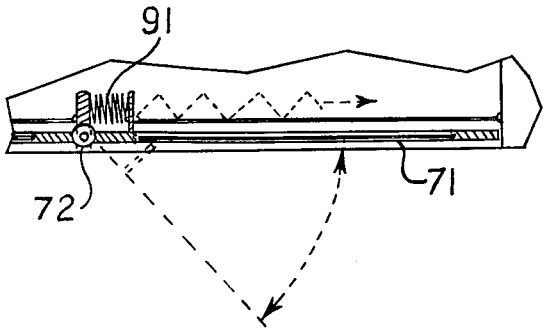

EMERGENCY BUILDING ESCAPE LADDER

CROSS REFERENCE TO RELATED PATENT APPLICATIONS

There are no related patent applications filed by me.

BACKGROUND OF THE INVENTION

1. Field of the Invention

This invention is in the general field of fire emergency exits and the like, for buildings, and is more specifically directed to a segmented safety ladder arrangement wherein the ladder for one floor is held horizontally within the building for that floor and between the two floors, and wherein upon extension a like ladder may be interlocked for the next floors above and below; and safety devices are provided so users of the ladder will not fall.

2. Description of the Prior Art

There have been so many fire ladders, such as rope ladders, hydraulically actuated extension ladders, and the like, that it would be futile to attempt to name all of them. The art is well known, however, to those engaged in fire safety operations. All of such ladders and permanently attached exit stairways and the like are either permanent attachments on the exterior of the building or are in the nature of items which must be brought from a distance or dropped from a high area in the building such as rope ladders. None of these are thoroughly satisfactory, and most are difficult to traverse. This is particularly true for rope ladders or other hanging ladders, since they have a tendency to sway and to not hang, or be supported suitably, from the building.

The present invention relates to a ladder which becomes permanently attached when utilized in segments which interlock with one another between the floors of the building, but which disappear between the floors of the building when not utilized. In this sense there is no prior art.

SUMMARY OF THE INVENTION

There are numerous deaths caused each year by fires in high buildings, wherein it is impossible for persons, trapped above the floor level of a fire, safely to exit. This is because many buildings are too high to be reached by extensible ladders, are too high for effective jumping into safety nets and are incapable of exit where blocked by fire on the interior exit.

Numerous devices, such as rope ladders and the like, have been tried for evacuation of such buildings under emergency circumstances. Such devices as have been available in the past are generally totally incapable of proper utilization. Permanently attached ladders on the exterior of the buildings are seldom used since they deface the exterior of the building and great emphasis is placed upon building appearance, and they present intruder hazards.

I have studied this problem extensively with the view to attaching, in some manner, a ladder in a generally fixed arrangement so as to be easily climbed or descended by ordinary persons. At the same time, I have attempted to give consideration to the fact that permanently constructed ladders are unacceptable.

After considerable consideration and development, I have developed a ladder apparatus which results in a fire ladder which becomes essentially rigidly attached to a building when needed, but stores, when not needed, in a horizontal position between the floors of a building; In each case that portion of the ladder so stored being segmented so as to accommodate one floor with appropriate interlocking arrangements to accommodate the ladder between each of the floors above and below.

I have accomplished this by providing a ladder which is formed in short segments, and in which the segments are hinged together and carry appropriate feet to rest against the exterior of the building to hold the ladder in contact with the building. The total number of segments required consists of that number required for the complete coverage of the floor together with the interlocking portions for attaching above and below to the next succeeding total sections.

I have arranged such ladder so that it runs on appropriate rollers or the like between the floors in a horizontal position so that the building exterior is not defaced by the ladder, yet in which the ladder can be extended almost instantaneously, automatically or manually, upon the occurrance of an emergency. I have further equipped the ladder with safety devices such that persons unaccustomed to long climbing or descending on ladders may have rest places at which they may safely rest without danger of falling from the ladder.

I have further provided appropriate window exits of a decorative nature in conjunction with the location of the ladder so that the ladder may be appropriately utilized from each floor.

I have further incorporated means to retract the ladder when the emergency is over and when not used.

I have further incorporated an overall system for a building wherein the exits are appropriately protected against use except when the ladder is extended, and wherein means are provided to ensure against the possibility of a draft enhancing any fire which may have been started. Other features for safety of the of the overall system have been incorporated which are shown in the drawings and are described in the description of a preferred embodiment which follows.

It is an object of this invention to provide a disappearing ladder arrangement for buildings to be utilized on the exterior of the building during emergencies.

It is another object of this invention to provide a ladder which can be stored in segments between floors of a building such that when all segments are connected the entire height of the building will be covered by one continuous ladder;

Another object of this invention is to provide such a ladder as described which can be safely negotiated by persons of ordinary physical prowess.

The foregoing and other objects of this invention will become clear to those skilled in the art upon reading the description of a preferred embodiment which follows in conjunction with a review of the drawings.

BRIEF DESCRIPTION OF THE DRAWINGS

FIG. 13 is an enlarged, partially broken away, perspective, of a portion of a building utilizing the ladder of this invention, showing the actual application thereof;

FIG. 14 is an enlarged, partially segmented view of an alternate draft blocking exit arrangement; and FIG. 15 is an enlarged top view of the draft blocking arrangement of FIG. 14.

DESCRIPTION OF A PREFERRED EMBODIMENT

Figure 1:
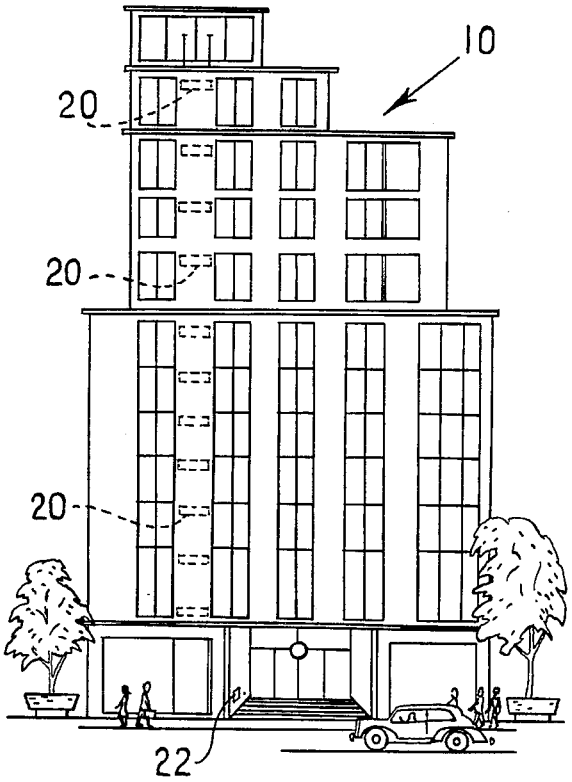
FIG. 1 is a front view of a building utilizing the ladder of this invention in which the location of the ladder when not being used is shown in phantom.

FIG. 1 illustrates a building of substantial height, in which the invention of this patent application is utilized. The building, generally 10, has a multiplicity of floors, and at 20 has a multiplicity of openings, one for each floor, which are normally closed and are shown in phantom since they will become opened when the ladder of this invention is removed. A control panel for this system may be located at the entrance of the building in the area 22, or some other convenient location.

Figure 2:
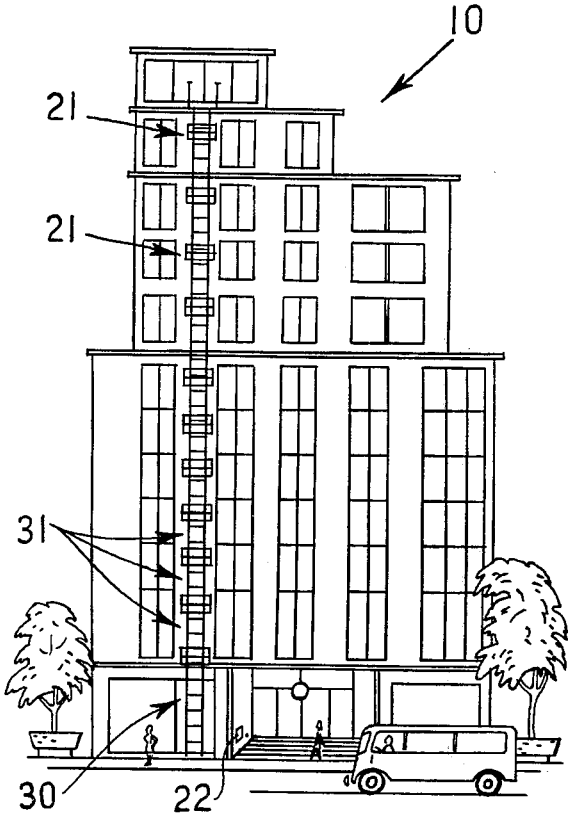
FIG. 2 is a figure similar to FIG. 1 wherein the ladder of this invention is shown in its position of use.

In FIG. 2 the same building of FIG. 1 is portrayed at a different time, after the ladder of this invention has been extended from its storage position between floors and is in its fully extended and interlocked position. Individual openings 21 are now shown to be opened, with their closures extending beneath, and individual ladder segments 31 are shown in position and interlocked by the means which are explained in greater detail below. The overall ladder is indicated generally as 30 and consists of the multiplicity of segments 31.

Figure 3:
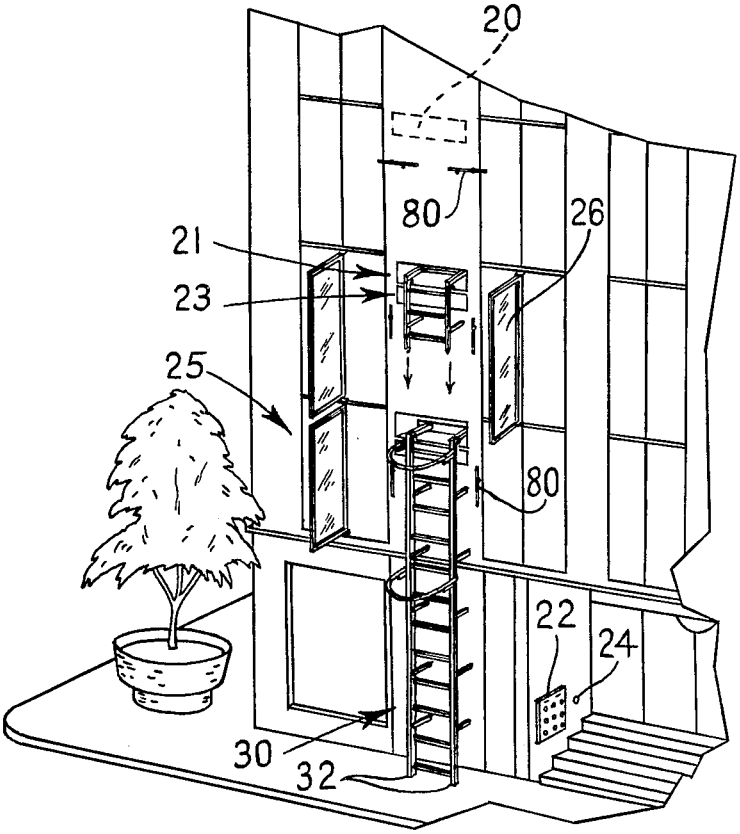
FIG. 3 is an enlarged view of a portion of the building of FIG. 2 before the ladder is completely in place, and showing windows being opened for exit onto the ladder.

FIG. 3 illustrates in somewhat more detail the closed opening 20 wherein a ladder segment is stored in a horizontal position between floors, it illustrates at 80 window locking members which will be explained in more detail below, and it shows a portion of the ladder 30 fully extended and resting upon feet 32 with interlocking segments (detailed below) in position, and a ladder segment moving towards segments already in place. Exit windows 25 and 26 are illustrated and the opening 21 with its cover plate 23 out of position is well pointed out. The control panel 22 is shown, and the auxiliary control 24 is also illustrated. The auxiliary control 24 is merely a means wherein an appropriate crank of the like, may be inserted for manual operation of the ladder segments overriding the electrical control panel 22 in the event this becomes necessary. This will be understood by those skilled in the fire protection arts. The control panel 22 will provide a control for each individual segment as desired, but it is recognized that there may be an electrical failure at a critical moment. Those who are engaged in the fire protection occupations recognize that fire protection personnel are accustomed to carrying a number of tools for various uses, one of which can be a crank which can be inserted at 24 and an individual could manually activate the ladder segments. At FIG. 4, there is an enlarged, broken away, portion of a ladder, particularly, at a hinging segment area showing some of the essential safety features utilized. Each ladder segment will consist of a number of short units 40, each comprising a pair of side members 41 and 42, with a series of rungs 44 as will be understood by those accustomed to the use of ladders. Individual ladder segments 40 will be hinged at 43 by customary means. Each ladder segment will have at least one pair of support arms 45 pivotally mounted at 50 to the side members, and activated into the horizontal position shown in FIG. 4 by springs 46. These members will maintain the ladder at a distance from the wall of the building so that safe climbing can be accomplished.

Figure 4:
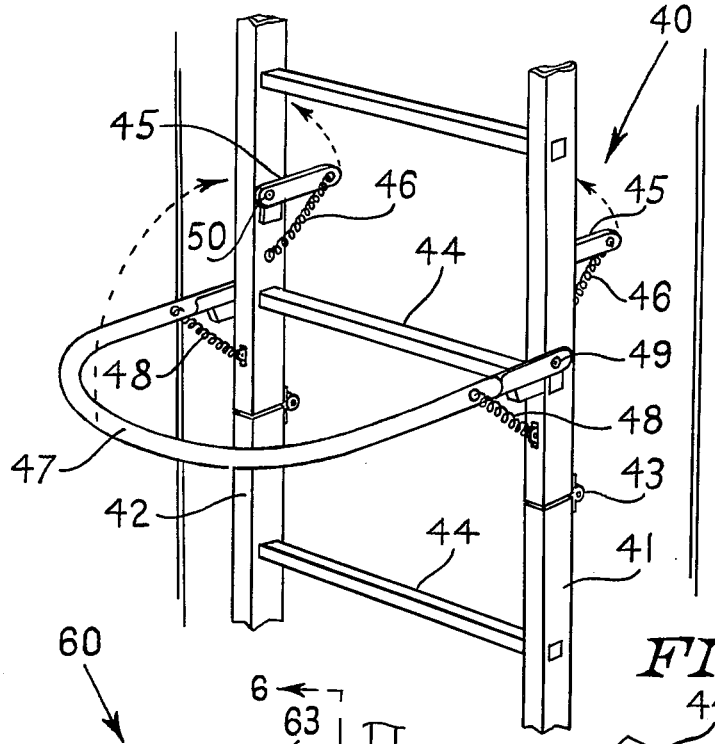
FIG. 4 is an enlarged broken away view of a portion of the ladder of this invention showing certain preferred safety elements.

Additionally, there will be a multiplicity of safety hoops 47 pivotally mounted at 49 to the ladder segments, and pulled into position as indicated in FIG. 4 by springs 48. With the utilization of these hoops 47, the user of the ladder will have safety from falling, as well as a position of rest which can be accomplished by leaning against the hoops.

Figure 5:
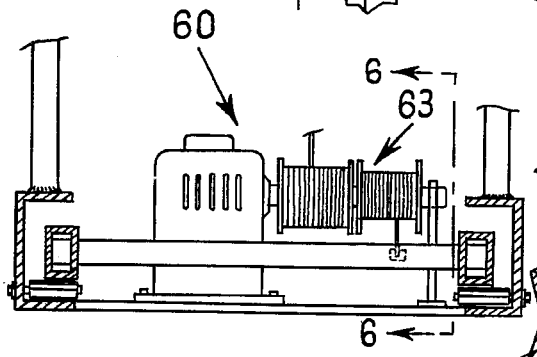
FIG. 5 is a schematic front view of an actuating mechanism for a portion of the ladder of this invention.
Figure 6:
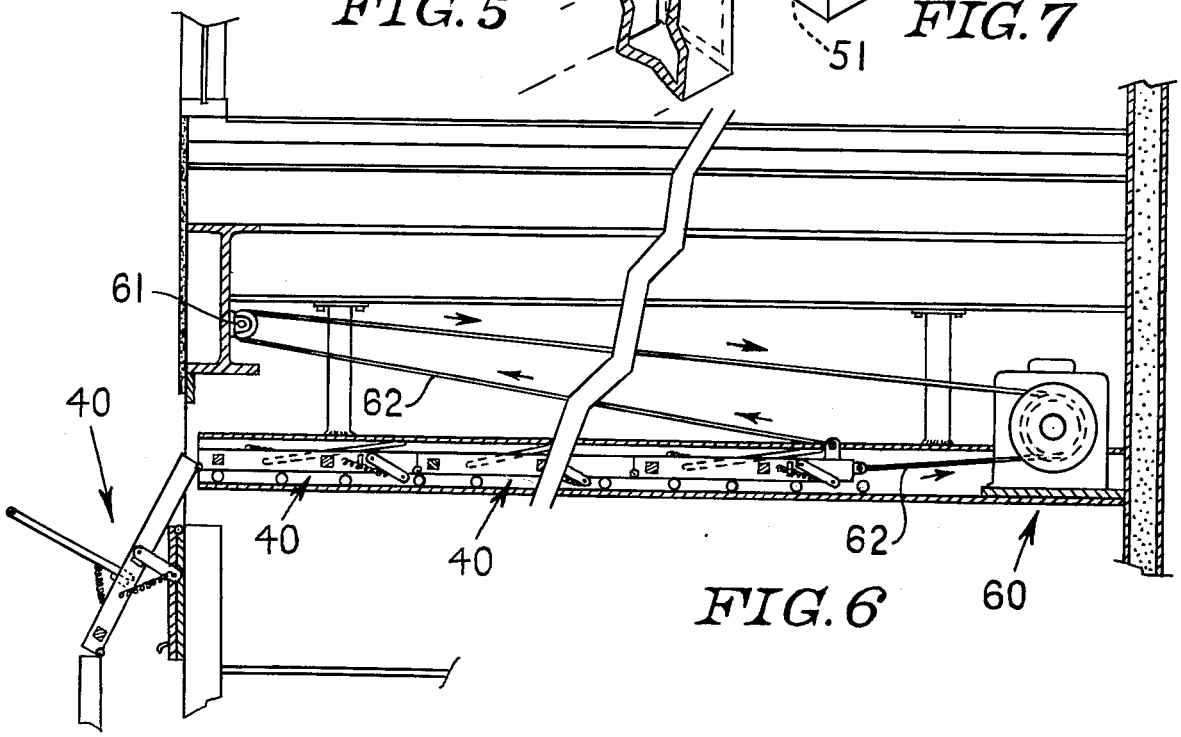
FIG. 6 is a section on 6—6 of FIG. 5.

FIG. 5 illustrates, in enlarged fashion, a view from the front of the building of a stored ladder, partially in perspective, primarily designed to show one possible means of activation of the ladder electrically. A motor 60, with a winch arrangement 63 can be utilized. FIG. 6 is a section on 6—6 of FIG. 5, and illustrates a number of important features. A base 60 for the mounting of the motor has been provided, and this same base provides a mounting arrangement for a series of rollers, the exact construction of which is not shown, since the use of rollers and their mounting is well known to those skilled in the mechanical arts. The multiplicity of ladder segments 40, in this particular view, have been shown to have been partially extended to the exterior of the building, with further segments still to be extended. A cable 62, or the like, is utilized to pull the segmented ladder arrangement up towards its extended position. The mounting of the cable at the last ladder segment is such that it may detach itself when the ladder is fully extended. Details of this have not been shown, since it will be understood. For example, the cable mounting which is utilized to extend the ladder may be mounted in the slide so that when the ladder is about to be fully extended, the mounting will slide out, the ladder will, by its own weight, be extended the final portion for its interlocking with the lower segment. Also, the pulley arrangement 61 may be so adapted as to swivel, if desired, near the end of the pulling of the ladder into position.

Figure 7:
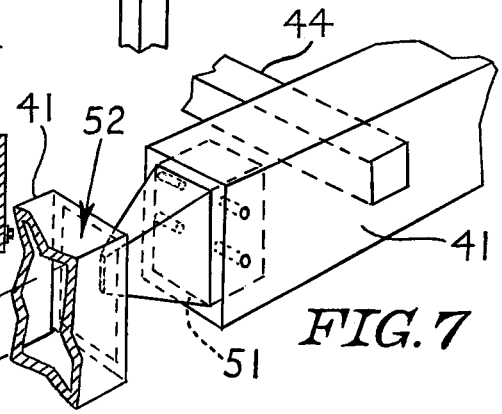
FIG. 7 is an enlarged view of the end of one of the rails of the ladder of this invention to show the interlocking arrangement.

FIG. 7 illustrates in enlargement, the end of the lower portion of the ladder segment. The rail 41 is shown with the rung 44, and an insert 51 in the end of the rail. In this case the rail may be made of hollow, extruded material, or the like.

The member 51 is so shaped that it will be self-centering within the ladder segment immediately beneath it, and it will enter the opening 52 in the matching ladder segment 41 below.

Figure 8:
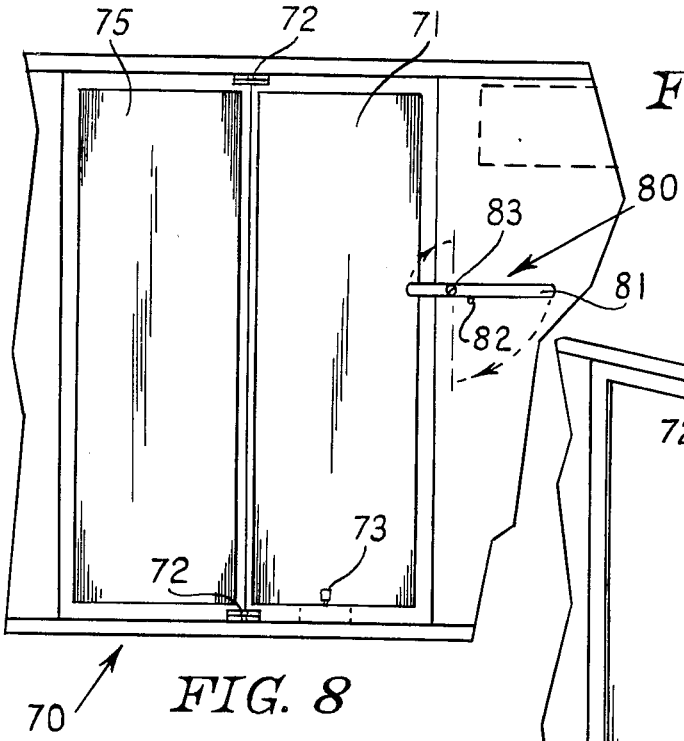
FIG. 8 is a broken away portion of a building exit for access to the ladder of this invention showing safety locking device in position.
Figure 10:
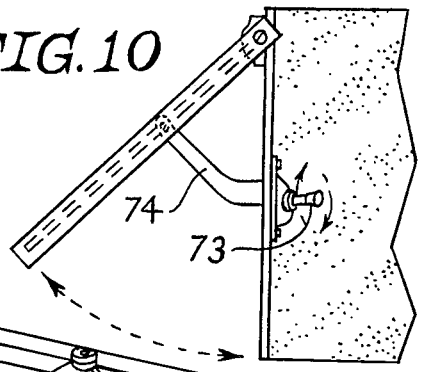
FIG. 10 is a top view, enlarged, of a portion of FIG. 9, to show an exit activation device.
Figure 9:
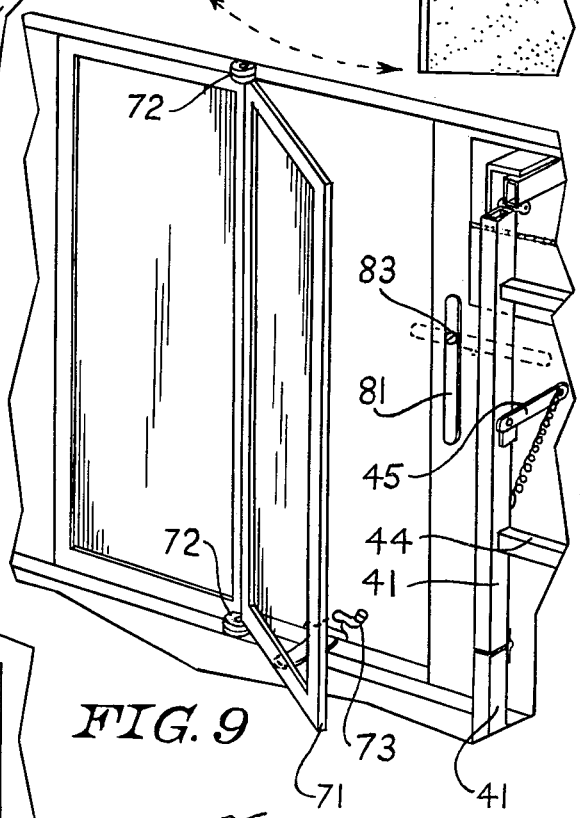
FIG. 9 is a perspective view of the exit window shown in FIG. 8 after the locking device has been automatically unlocked by utilization of the ladder of this invention.

Of particular importance in this system is the actual means to exit the building and to mount upon the ladder. FIGS. 8, 9, and 10 illustrate one preferred manner in which a number of different requirements can be met at once. A window area generally 70 is shown wherein there is a double window 71 and 75, and in which the portion 75 is fixed to the building. The portion 71 hinges and is pivotally mounted at positions 72 by means known in the art. A crank handle arrangement 73–74, customary in the art, can be utilized for the opening of that window. Because of safety regulations in most buildings, however, it will be necessary that the window 71 cannot be opened except in emergency circumstances. Thus, there is a locking arrangement 80 comprising a bar 81 pivotally mounted at 83, with a safety shear pin 82 as indicated. The locking effect of the bar 81 holds the window 71 against opening as long as the bar is in the position shown in FIG. 8.

When the ladder is extended, it strikes the bar 81 and this force breaks the shear pin 82 and of course drops the bar 81 out of position. The exact action and the manner in which the ladder strikes the bar is illustrated in FIG. 13 and will be described below. When the bar has been knocked out of position, the window is opened by the utilization of the crank arrangement 73, and the person using this device for escape may step upon the rungs 44 directly from the window. In the particular illustration of FIG. 9, it is to be understood, that the ladder has not been fully extended as yet, but this has been shown so as to show what is happening during the emergency wherein the window is being opened immediately after the safety bar 80 has been released, so that the moment the ladder is fully extended the user may utilize it.

Figure 11:
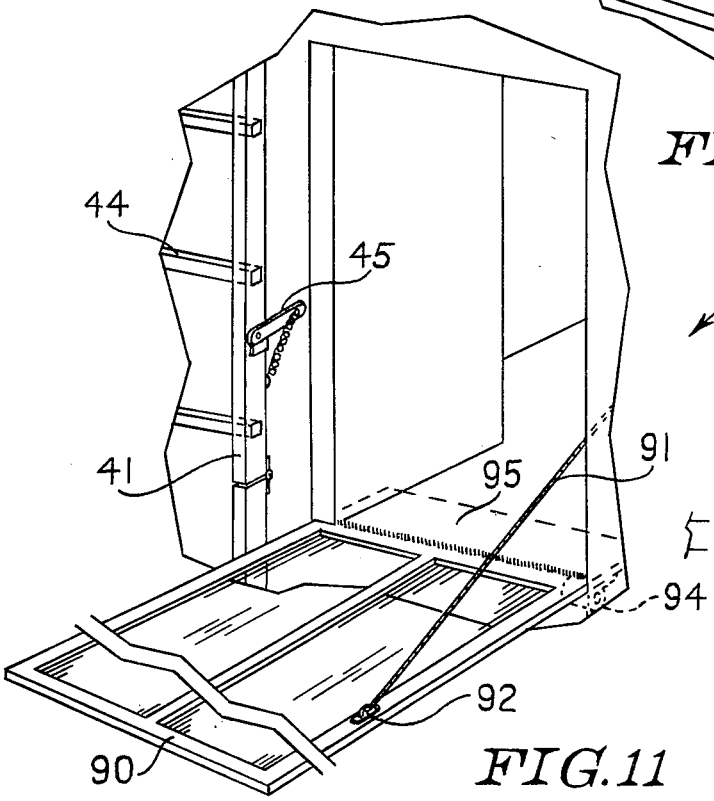
FIG. 11 illustrates an alternate embodiment of an exit window of the building utilizing the ladder of this invention.
Figure 12:
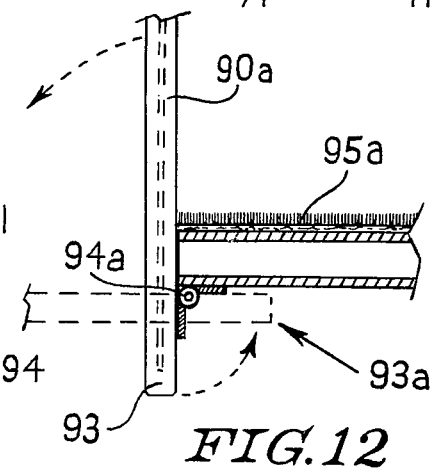
FIG. 12 illustrates an alternate exit safety arrangement.

FIG. 11 shows an alternate window arrangement, by which the window, in this case 90, may open outwardly in the manner shown, and will be held in a horizontal position, when open, by chain or the like 91 fastened to bracket 92 on the window, and appropriately fastened to the wall inside by means known in the art, but not shown. This window 90 would be hinged as at 94 so as to open in the manner shown. The area 95 can be an area having some type of safety step arrangement such as 95A as shown in FIG. 12. Such an arrangement will warn a user of the stepping forward onto the window 90. From the window 90 in its extended position as shown in FIG. 11, the user can mount upon the ladder rungs 44.

FIG. 12 shows an alternate safety arrangement which may be used if desired, but complicates the building structure. In this case, the window frame 93 extends below the mounting 94A in such manner that when opened, the window 90A would be further supported by the frame end 93A. In this case, there would have been appropriate building structure opening to allow the frame 93 to move to the position shown at 93A in phantom. This opening would not adversely affect the building appearance, since the window would extend to cover the opening and it would not be generally visible from the exterior.

FIG. 13 illustrates in somewhat more detail the actual use of this emergency ladder arrangement, and shows the manner in which a still further embodiment of a protective device may be utilized.

At the upper portion of FIG. 13, a locking bar 81 pivotally mounted at 83 with shear pin 82 is shown. The ladder is shown in the upper portion descending and about to break the shear pins 82 so as to unlock the excape windows 71. It will be noted how persons are already utilizing those portions of the ladder which are fully extended, and it will be seen how they will now descend. It is also shown how the safety hoop will protect them.

The folded door arrangement behind the open window 71 is explained in more detail in FIGS. 14 and 15. The excape window 71 is illustrated in FIGS. 14 and 15 showing its ability to open and close. The folded door 90 is activated by spring 91 which will normally keep it in a closed position, even when escape window 71 is open. This folded door can act, and will act, as a block to any draft during times when persons are not actually using the escape exit. With the window 71 open, however, a user need only push the folded door 90 and step out. When the user leaves, the spring 91 will return the door to its position.

Other draft blocking arrangements will occur to those skilled in the art, such as a spring loaded interior opening member, or the like, (not shown). These are mechanical details which need not bother those following the teachings of this invention at this time, since individual variations may be adapted as desired or required by particular architectural details and the like.

It is to be understood that what has been illustrated is one embodiment of a system for an escape ladder arrangement for tall buildings wherein it is desired to have the ladder invisible and unusable except in times of emergency, yet readily extensible and with safety features when desired.

The embodiments of this invention specifically shown and described, are only for purposes of illustration, and have not been shown as described for purposes of limitation.

I claim:

1. The method for providing escape capability for multistory building comprising: (1) installing a ladder intermediate each floor of the building in a horizontal position; (2) covering each ladder segment so installed from the exterior of the building with a removable building opening cover; (3) removing each said cover when an emergency occurs requiring exterior building exit; (4) extending each stored ladder segment sequentially so that the lower segment is fully extended prior to the segment above it being fully extended; (5) fully extending each subsequent higher ladder and causing the same to interlock with the lower previously extended segment; (6) causing an exit to be opened adjacent the ladder for each floor of the building; and, (7) removing the ladder from the exterior of the building when an emergency situation has been completed.

2. The method of claim 1 wherein a blocking device is interposed between the escape opening and the interior of the building in an openable fashion.

3. The method of claim 2 wherein each ladder segment is caused to be removed from direct contact of the rungs of the ladder to the building upon extension.

4. The method of claim 3 wherein safety personnel retaining hoops are caused to be extended concurrent with the extension of the ladder segments.

5. The method of claim 4 wherein safety locking arrangements are installed upon each escape exit which safety locking arrangements are removed by means of the extension of ladder segments.

6. Safety ladder means comprising: (1) a multiplicity of ladder sections, each section comprising a number of hinged segments; (2) means to store each section between the floors of a building; (3) means to extend each section upon the occurance of an emergency so that it is vertically disposed on the exterior of the building; (4) means upon the ends of each section to interlock each section with the section immediately above such section upon said building; (5) means to support each section at a distance from the building when in a vertical position with relation thereto; (6) hoop means cooperative with each section so that a person traversing the ladder when in vertical position may lean against such hoop means; (7) means to extend such sections from their stored position between the floors of the building to their vertical position adjacent the exterior of the building; (8) exit means on said building cooperative with said ladder sections so as to allow persons to exit from within the building on to said ladder sections; (9) means to block drafts from entering through said exits when not actively in use.

7. The apparatus of claim 6 wherein said exits are locked when the ladders are stored between the floors of the buildings which locks are unlocked, automatically, by the extension of the ladders into vertical position.

* * * * *